US005666128A

United States Patent [19]

Murray et al.

[11] Patent Number: 5,666,128

[45] Date of Patent: Sep. 9, 1997

[54] MODULAR SUPERTILE ARRAY ANTENNA

[75] Inventors: Bronson Murray, Freehold, N.J.; James Paul Foley, Yardley, Pa.; Thomas MacKenzie Stuart, East Windsor; Fred Manfred Weiss, Moorestown, both of N.J.

[73] Assignee: Lockheed Martin Corp., East Windsor, N.J.

[21] Appl. No.: 622,725

[22] Filed: Mar. 26, 1996

[51] Int. Cl.[6] ..... H01Q 1/12

[52] U.S. Cl. ..... 343/878; 343/705; 343/DIG. 2

[58] Field of Search ..... 343/878, 879, 343/700 MS, 705, 725, 880, 881, 915, DIG. 2; 342/354, 372; H01Q 1/38

[56] References Cited

U.S. PATENT DOCUMENTS

| | | | |
|---|---|---|---|
| 4,343,005 | 8/1982 | Han et al. | 343/DIG. 2 X |
| 4,375,878 | 3/1983 | Harvey et al. | 343/DIG. 2 X |
| 4,377,266 | 3/1983 | Belew et al. | 343/DIG. 2 X |
| 4,562,441 | 12/1985 | Beretta et al. | 343/DIG. 2 X |
| 4,581,614 | 4/1986 | LaCourse | 343/368 |
| 4,987,425 | 1/1991 | Zahn et al. | 343/853 |
| 5,087,920 | 2/1992 | Tsurumaru et al. | 343/700 |
| 5,128,689 | 7/1992 | Wong et al. | 343/853 |
| 5,160,936 | 11/1992 | Braun et al. | 343/725 |
| 5,223,850 | 6/1993 | Branigan et al. | 343/771 |
| 5,293,171 | 3/1994 | Cherrette | 343/700 |
| 5,327,150 | 7/1994 | Cherrette | 343/771 |
| 5,430,451 | 7/1995 | Kawanishi et al. | 343/DIG. 2 X |

*Primary Examiner*—Donald T. Hajec
*Assistant Examiner*—Tho Phan
*Attorney, Agent, or Firm*—W. H. Meise; C. A. Berard; S. A. Young

[57] ABSTRACT

An array antenna especially adapted for spacecraft use includes a support frame made up of intersecting beams which form an "eggcrate" of square openings. A plurality of subarrays or radiating tiles are dimensioned to fit within the openings. Distortion of the support frame due to external forces, or due to expansion and contraction of the radiating tiles, is accommodated andor resisted by a four-point mounting arrangement for each tile. Each mounting is located on the center of the sides of the radiating tile, and the corresponding center of the side of the opening in which it fits. Each mounting consists of a thin, flexible mounting beam, extending parallel to the associated support beam, and fastened to the support beam at the ends of the mounting beam. The center of the side of the tile is fastened to the center of the flexible support beam, so expansion and contraction of the tile are compensated by bending of the flexible beam. Mutually opposing external forces acting parallel to the elements of the support frame are resisted by the longitudinal stiffness of the flexible beam and the diagonal stiffness of the tile.

10 Claims, 9 Drawing Sheets

MODULAR SUPERTILE ARRAY ANTENNA

FIELD OF THE INVENTION

This invention relates to antennas for spacecraft, and more specifically to array antennas which are modular, so that a spacecraft may have its antennas made up of standard subarrays mounted in a standardized structure.

BACKGROUND OF THE INVENTION

The costs of communications spacecraft are under downward pressures due to competition among spacecraft manufacturers, and also due to competition with other forms of communications. Modularized spacecraft techniques are described in U.S. Pat. No. 5,344,104, issued Sep. 6, 1994 in the name of Homer et al.; U.S. Pat. No. 5,351,746, issued Oct. 4, 1994 in the name of Mackey et al., and U.S. Pat. No. 5,310,141, issued May 10, 1994 in the name of Homer et al. These techniques use standard modules to make spacecraft buses (payload carriers) of various sizes and capabilities, thereby reducing design costs, and particularly by reducing the need to space-qualify different structures which might be used to construct custom spacecraft using earlier techniques. Other techniques for reducing the costs of assembling buses have been implemented, such as the misalignment tolerant fasteners described in U.S. Pat. No. 5,324,146, issued Jun. 28, 1994 in the name of Parenti et al.

Payloads have been more resistant to cost reduction, because they are, almost by definition, different from each other. Each spacecraft user specifies the number of communications channels which are to be carried, their frequencies, and the power to be delivered to a specified "footprint" on the Earth's surface. The electrical power modularization required to provide the desired total radio-frequency (RF) power is described in the abovementioned patents. The antennas, however, have been more resistant. In the past, reflector/feed antennas were used on the spacecraft, with the reflector and the feed being designed to provide the desired footprint over the specified frequency range. The reflector/feed arrangement using horn feed antennas exhibits high efficiency, which is very desirable in view of the electrical power limitations common to spacecraft. However, the reflector/feed antenna is difficult to design, and multiple feed horns may be required in order to provide the appropriate footprint. Once the spacecraft is launched, the footprint cannot be changed, except by switching among the feed antennas. Also, the reflector portion of the antenna is resistant to folding, so its overall dimensions must be chosen to fit within the streamlining shroud of the launch vehicle. The size limitation, in turn, tends to limit the directive gain of the antenna, so that narrow or spot beams are difficult to obtain. Further, a reflector-type antenna is subject to physical distortion as a result of differential heating occasioned by insolation. The physical distortion, in turn, disrupts the desired footprint. Various RF-transparent insolation shields have been used to cover the radiating surface of reflector antennas, to minimize the distortion, as described, for example, in U.S. Pat. No. 5,283,592, issued Feb. 1, 1994. To the extent that the thermal (or other) antenna distortion affects the footprint, no convenient remedy is available. When operation at a plurality of different frequency ranges is necessary, as when a satellite uplink and downlink are at different bands, such as C and X band, multiple reflector antennas are required, which exacerbates the abovementioned problems. Further problems arise from the "frequency reuse" operating method, used to maximize the number of separate channels which may be used within each band, by transmitting alternate channels of each band with different polarizations, and using a polarization-sensitive reflector/feed arrangement, as described in more detail in, for example, U.S. Pat. No. 5,023,619, issued Jun. 11, 1991 in the name of Balcewicz, in that the reflector structure is much more complex than in a simple continuous reflector.

The considerations relating to reflector/feed antennas have directed attention to other types of antennas for communications spacecraft, notably antenna arrays. Antenna arrays are well known in the art, and their use in conjunction with aircraft and spacecraft is well known, although the number of such arrays in actual use in spacecraft is very small, due to a number of practical problems. Among these problems is that of the size, weight, complexity, and the attenuation or loss of the beamformer, such as that described in U.S. Pat. No. 5,274,839, issued Dec. 28, 1993 in the name of Kularajah et al., which is required to feed the RF signal to the antenna elements. Also, an array antenna must maintain a predetermined spacing between each antenna element and other elements of the array to prevent grating lobes.

Those skilled in the art know that antennas are reciprocal linear devices, in which the transducing characteristics during transmission and reception are the same. For example, the beamwidth, the gain (or more properly, the directive gain relative to an isotropic source) and the impedance at the feed points are the same in both transmitting and receiving modes. However, the terms used to describe antenna functions and characteristics were established at a time when this reciprocity was not apparent, and as a result the terms are suggestive of either transmission or reception, but generally not of both. Those skilled in the art know, therefore, that the description of an antenna may be couched in terms of either transmission or reception, or an intermixture of both, with the other mode of operation being understood therefrom. Thus, the term "feed port," for example, refers to the port to which signal energy is applied during transmission, and is also applied to that same port at which signal energy is received in a receiving mode.

Array antennas are of two general types, active and passive. The "active" antenna array includes active devices such as semiconductor devices to aid in reception or transmission, or both; a passive antenna array does not. The proper phase characteristics between the elements of the array must be provided in some way in either the active or passive arrays. An active antenna array will generally include controllable phase-shifters which can be used to adjust the phase of the RF signal being fed to one (or to a subset) of the antenna elements of the array. The need for a phase-shifting beamformer may be avoided by using a non-phase-controlled signal amplitude divider, in conjunction with control of the phase control elements associated with each element or subset of elements. An active antenna array will often have a transmit amplifier and a receive amplifier associated with each antenna or subset of antennas. These amplifiers add to the cost and complexity of the system, and are a major source of waste heat, which adds to the insolation heat, and must be taken into account. The cumulative effect of the heat absorbed by the array antenna, and that generated within the array antenna, tends to raise the temperature gradient of the array antenna, and to cause physical distortion, which in turn affects the radiation pattern and the resulting footprint. In general, antenna arrays for use in spacecraft have the disadvantages of weight, RF signal losses, and, in active embodiments, the energization power and waste heat removal requirements. The advantages of array antennas include the ability to control the beam characteristics by remote control of the phase shifters. Also, an array antenna may be folded for launch and then deployed, as described, for example, in U.S. Pat. No. 5,196,857, issued Mar. 23, 1993 in the name of Chiappetta et al.

Improved spacecraft antenna structures are desired.

SUMMARY OF THE INVENTION

An antenna array according to the invention includes a frame with a plurality of straight, elongated support beams, interconnected in two mutually orthogonal sets so as to, together, define a rectangular two-dimensional array of a first plurality of mutually identical rectangular, or preferably square, openings. Such a support structure is often referred to as an "egg-crate". The frame is potentially subject to distortion in response to forces acting on the frame. This may occur, for example, when a force is applied in a direction which is not parallel to the support beams, which "diagonal" force might distort the frame and the shape of an array supported thereby. More often, opposing forces act parallel to the support beams, which tend to bend, racking the rectangular apertures into distorted parallelogram-shaped openings. The antenna array includes a plurality of rectangular, electromagnetically radiating tiles. Each of the radiating tiles has length and width dimensions selected to fit within the openings of the egg-crate. In a preferred embodiment, one side of the radiating tiles radiates electromagnetic signals toward, and receives such signals from, the Earth, and also radiates heat to space in the general region of Earth, and the other side of the radiating tiles faces into space for rejecting heat. Each radiating tile has at least one radiating antenna, and preferably has an array of radiating antennas, on the radiating face thereof. The flex mounting arrangement associated with each rectangular opening and its radiating tile includes four mounts. The flex mounting arrangement connects the center of each side of each tile to the center of the associated support beam of the frame, for holding each tile centered in an associated opening of the frame. For this purpose, the "center" is a location half-way between adjacent orthogonal support beams. Each of the mounts includes (a) an elongated flex beam defining a thickness dimension, a width dimension greater than the thickness dimension, and a length dimension greater than the width dimension, (b) a spacer supporting the flex beam spaced away from the web of its support beam, and (c) a further connection arrangement connecting the center of the associated side of the radiating tile to the center of the flex beam. In a preferred embodiment of the invention, the spacer includes a pair of standoff spacers, each of which is affixed to an end of its associated flex beam and to the side of the associated one of the support beams, whereby the center of the flex beam may deflect toward and away from the center of the associated one of the support beams. With this arrangement, expansion and contraction of the radiating tile cause the center of the flex beams to deflect toward and away from, respectively, their associated support beams, whereby each of the radiating tiles remains centered in its associated opening.

DESCRIPTION OF THE INVENTION

Figure 1:
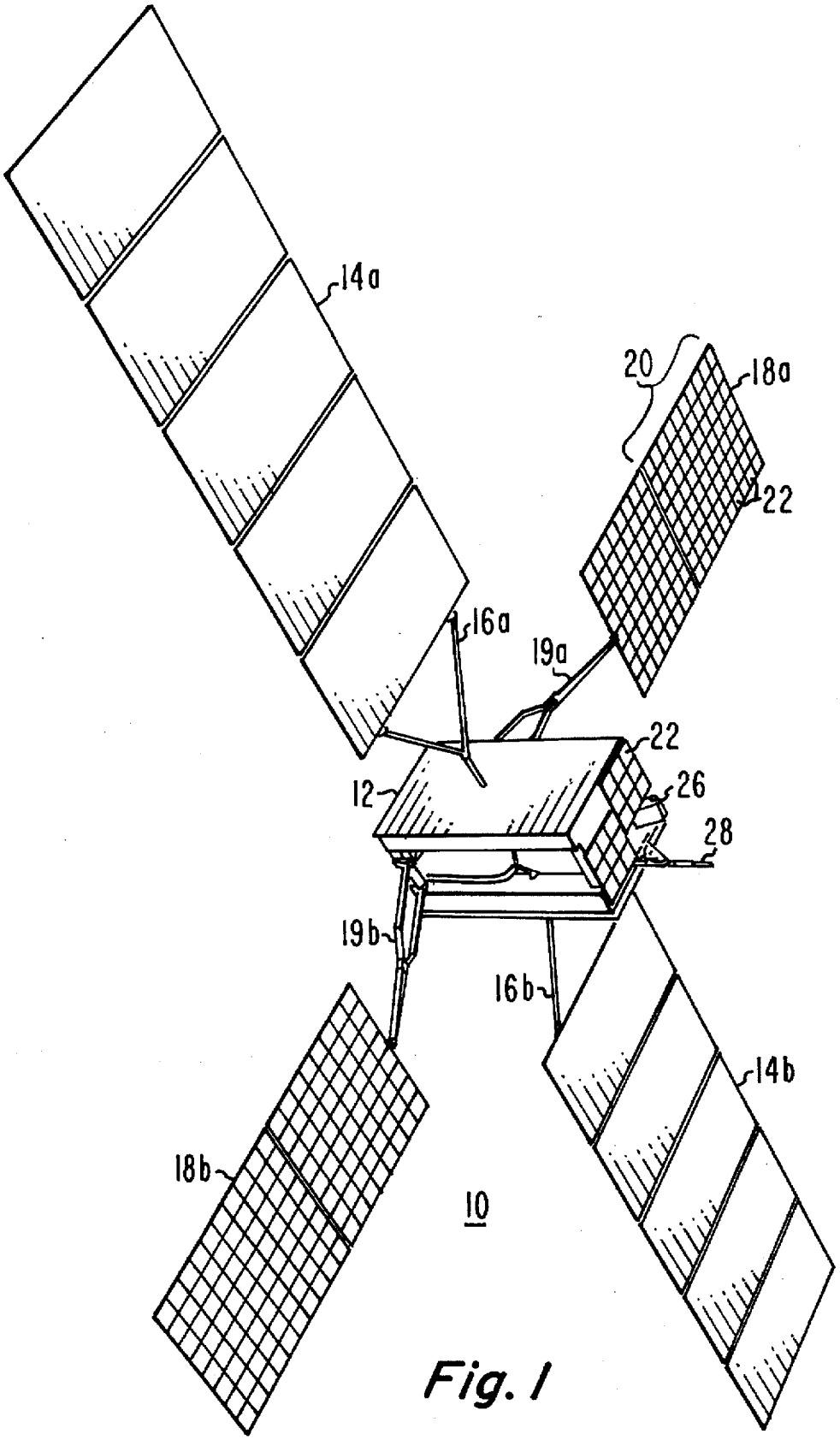
FIG. 1 is a simplified perspective or isometric view of a spacecraft including an array antenna according to the invention.

FIG. 1 is a perspective or isometric view of a communications satellite or spacecraft which may make use of the invention. In FIG. 1, spacecraft 10 includes a body 12, which supports deployed solar panels 14*a* and 14*b*. Each solar panel 14*a* and 14*b* is made up of a plurality of sections, as known in the art, which are mounted to body 12 by rotatable mounts 16*a* and 16*b*, respectively. An attitude control sensor is designated 26, and an omnidirectional antenna is designated 28.

A communications antenna designated generally as 18 includes a first deployed section 18*a* and a similar second section 18*b*, supported by mounts 19*a* and 19*b*, respectively. These sections are of similar construction, although they may include portions which operate at different frequencies. Antenna 18*a* includes two deployed panels, one of which is designated 20. The deployed panels are folded against the body 12 of the spacecraft 10 during launch, so as to fit within the fairing of the launch vehicle, and for best support of the panels. When folded against the body of the spacecraft, the panels are secured by means of pull-through cables (not illustrated). Panel 20 of FIG. 1 includes an array of radiating tiles, some of which are designated 22. Each radiating tile includes at least one antenna, and may itself include an antenna array. Each radiating tile also provides for distribution of RF signal (which may be at microwave, millimeter wave, or other frequencies) to the various antennas located thereon, as well as amplification, phase shifting, and the like. The electrical power and RF connections do not constitute part of the invention, and are not illustrated. As illustrated in FIG. 1, antenna panel 20 is an 8×10 array of radiating tiles. Some additional radiating tiles 22 are mounted on body 12 of spacecraft 10.

Figure 2:
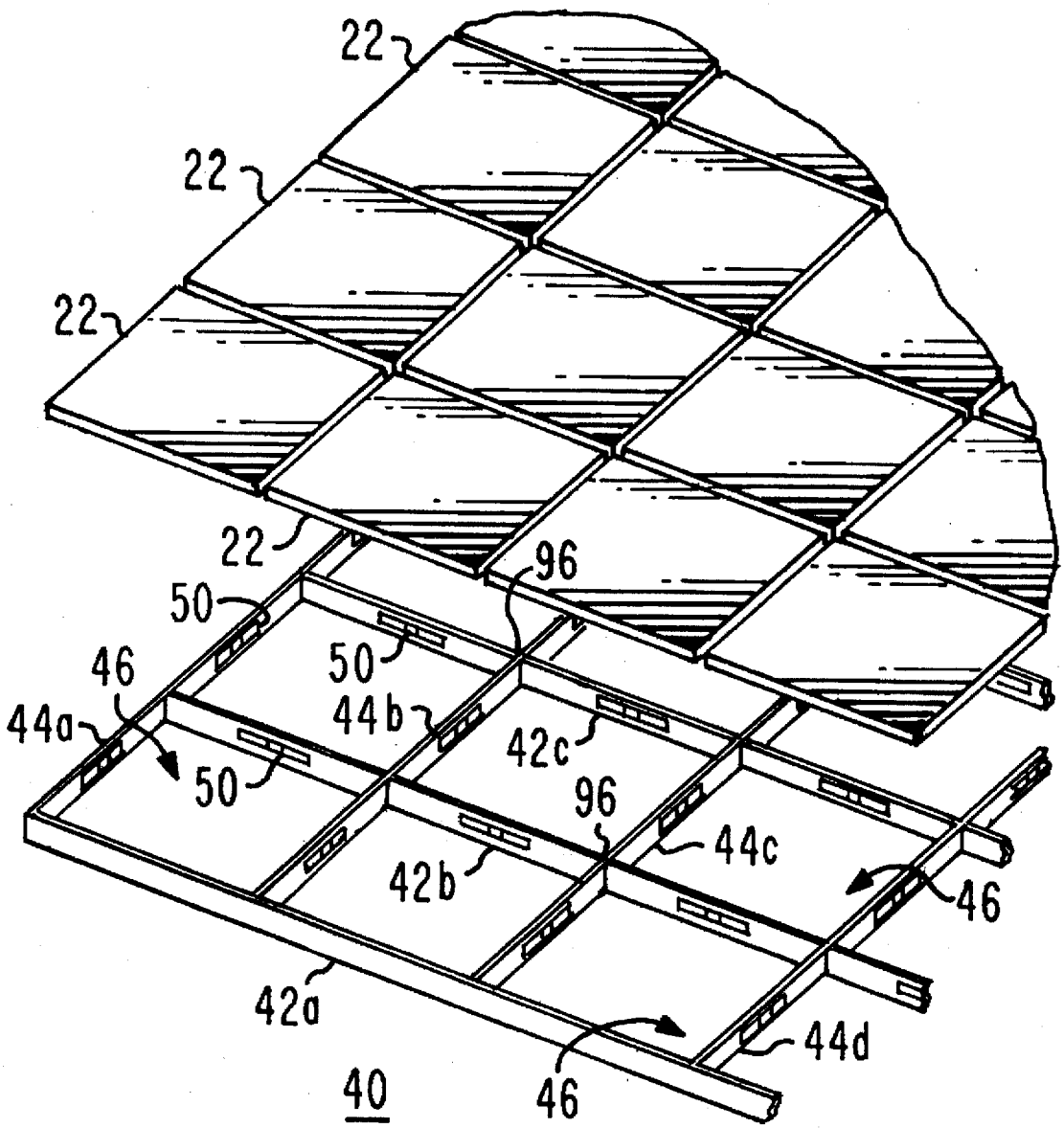
FIG. 2 is a simplified perspective or isometric view, partially exploded to illustrate the relationship of the parts thereof, of a portion of one of the array antennas of FIG. 1.

FIG. 2 is a simplified, exploded view of a portion of antenna panel 20 of FIG. 1, illustrating a plurality of radiating tiles 22, and also illustrating the "egg-crate" support structure 40 which holds the radiating tiles 22 in place during operation. Structure 40 of FIG. 2 consists of a plurality of elongated structural members or beams, with elongated structural members 42*a*, 42*b*, 42*c*, . . . running mutually parallel in one direction, and with additional mutually parallel structural members 44*a*, 44*b*, 44*c*, 44*d*, . . . running orthogonal to the structural members 42*a*, 42*b*, 42*c*, . . . . At the intersections of the structural members, they are fastened together. In a preferred embodiment of the invention, the structural members 42*a*, 42*b*, 42*c*, . . . and 44*a*, 44*b*, 44*c*, 44*d*, . . . are fused, welded or bonded at the corners or intersections. When so arranged, the structural members or beams define a plurality of rectangular or square cavities or apertures, some of which are designated 46. Apertures 46 are dimensioned to accommodate tiles 22.

When each of the tiles 22 has a plurality of antenna elements thereon arranged in an array with a particular inter-element spacing, and tiles 22 are to be assembled into a structure such as that of FIG. 2 for producing a larger array or panel array, it is important to keep adjacent tile boundaries close to each other so that the inter-antenna element spacing at the boundary between tiles 22 differs little from the inter-element spacing on the tiles themselves, to maximize effective isotropic radiated power (EIRP), and to minimize grating lobes. Thus, the elements of support structure 40 must be relatively thin. Support structure 40 must, however, be sufficiently strong to support each tile in its place, and to withstand launch forces, and other forces which act on the deployed antennas, such as stationkeeping and attitude control, and especially those forces which act on the support during deployment of the various panels. Furthermore, the support structure must also maintain the spacing of the tiles notwithstanding substantial temperature fluctuations, such as may occur when the antenna transitions from shadow to sunlight. When the structural members 42*a*, 42*b*, 42*c*, . . . , and 44*a*, 44*b*, 44*c*, 44*d*, . . . of FIG. 2 are made from aluminum, the expansion of aluminum is such that side-by-side 12-inch by 12-inch tiles are maintained within reasonable tolerances vis-a-vis the array requirements, but in an 8×10 array such as that illustrated in FIG. 1, the mutual spacing between tiles at opposed edges of the support tends to change sufficiently to disrupt the antenna pattern.

In a preferred embodiment of the invention, the structural members are made from graphite composite with a temperature coefficient of expansion which is near zero. While the tiles themselves may still expand and contract with temperature, but, in accordance with an aspect of the invention, each radiating tile 22 of FIG. 2 is supported within a corresponding aperture 46 by four flex mounting arrangements, some of which are designated 50. These flex mountings isolate the frame from the expansion or contraction of the tiles, and thereby decouple the tile distortion from the frame, so that the in-plane and out-of-plane distortion does not accumulate over an 8×10 panel structure. These flex mountings connect the in-plane stiffness properties of the tiles to the frame to prevent racking due to external forces. Each mounting arrangement 50 is located at the center of that portion of the corresponding support beams 42*a*, 42*b*, 42*c*, . . . or 44*a*, 44*b*, 44*c*, 44*d*, . . . within an aperture 46. Thus, there are four mounting arrangements 50 associated with each eggcrate aperture 46. According to another aspect of the invention, the structural members are in the form of I or T-beams, so that the antennas of mutually adjacent tiles may be spaced apart only by the web of the beam.

Figure 3:
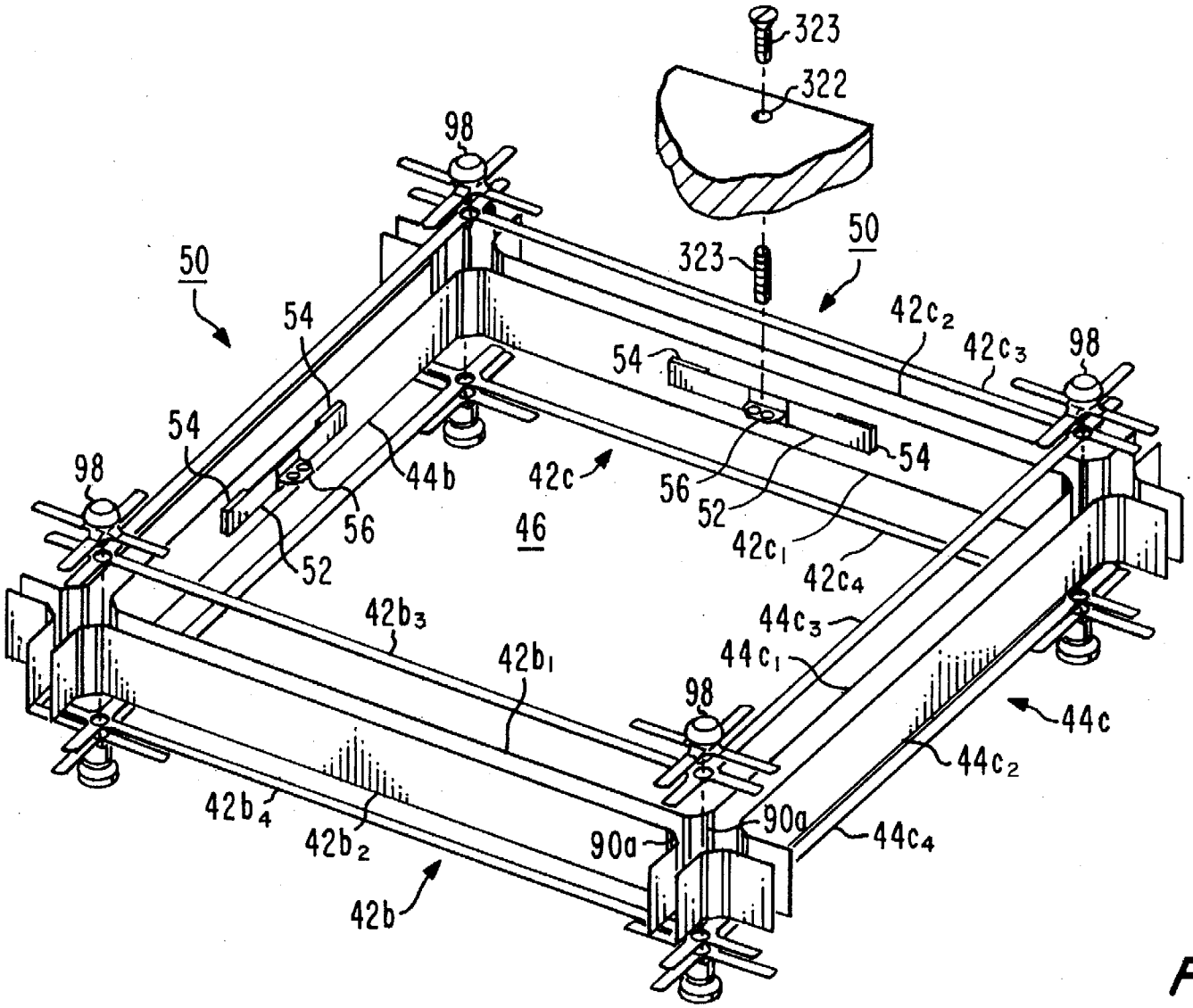
FIG. 3 is a simplified perspective or isometric view, partially exploded, of a portion of the arrangement of FIG. 2, illustrating more detail in relation to the flex mountings.

FIG. 3 illustrates one representative eggcrate aperture 46 of the arrangement of FIG. 2, showing somewhat more detail, and also showing a small portion of an edge of the radiating tile 22 associated with the aperture 46 of FIG. 3. Also, the structural members or beams illustrated in FIG. 3 are themselves exploded along their webs, to better illustrate certain apertures useful for allowing passage of retaining cables which retain the panels in place in the stowed condition.

In FIG. 3, each support beam is exploded. More particularly, each of the four support beams 42*b*, 42*c*, 44*b*, and 44*c* is an I-beam. Support I-beam 42*b* as illustrated includes a first web portion or half-web $42b_1$ and a second web portion $42b_2$ which are in actuality juxtaposed and part of a monolithic web, and also includes an upper flange element $42b_3$ and a lower flange element $42b_4$, which are monolithically part of the web. Similarly, support I-beam 42*c* as illustrated includes a first web portion or half-web $42c_1$ and a second web portion $42c_2$ which are in actuality juxtaposed and part of a single monolithic web, and I-beam 42*c* also includes an upper flange element $42c_3$ and a lower flange element $42c_4$, which are monolithically part of the web. The other support beams are also I-beams similar to those described, as for example support I-beam 44*c* includes a web illustrated in two portions $44c_1$, $44c_2$, together with an upper flange $44c_3$ and a lower flange $44c_4$.

As illustrated in FIG. 3, each of the half-webs is chamfered near its ends to jointly define an aperture. For example, half-webs $42b_1$ and $42b_2$ are chamfered near the corners of the aperture 46, as at locations 90*a* and 90*b*. The chamfer on the four half-webs which join at each corner result in a vertically disposed through aperture at the corner. Some of the vertically disposed through apertures are designated 96 in FIG. 2. The vertically disposed through apertures allow passage of retaining cables for retaining the panels in place during stowage.

Also in FIG. 3, corner-strengthening "spider" cups or cones 98 are bonded to the upper and lower webs of the I-beams at the corner apertures where the I-beams join. The spiders each have a through aperture through which the abovementioned retaining cables may pass. Each spider, when bonded into an end of the through aperture 90, reinforces the structure, and provides a bushing which prevents cable wear or damage to the I-beam sections within the aperture. When the antenna panels, such as 20 of FIG. 1, are folded together, each spider cup mates with a corresponding spider cone of the adjacent panel, and a similar mating occurs between the cones or cups of that one of the panels which folds into proximity with the body 12 of spacecraft 10. Thus, the cups and cones which mate in the stowed position of the deployable antenna array prevent racking or distortion of the panel frames due to shear loads.

In FIG. 3, only two of the four flex mounting arrangements 50 can be seen, and two more are fastened to, but obscured by, support members 42*b* and 44*c*. Each mounting arrangement 50 is located on the web of its support beam, midway between its two flanges, and midway between the two orthogonal support beams associated with the same rectangular aperture 46. More particularly, in FIG. 3, that mounting arrangement 50 which is mounted on the near face of half-web $42c_1$ of support beam 42*c* is mounted on support beam 42*c* at the illustrated location, which is equidistant from the two orthogonally intersecting support beams 44*b* and 44*c*, and equidistant from flanges $42c_3$ and $42c_4$, to provide a part of the support for a tile lying within the aperture 46 of FIG. 3.

Figure 4:
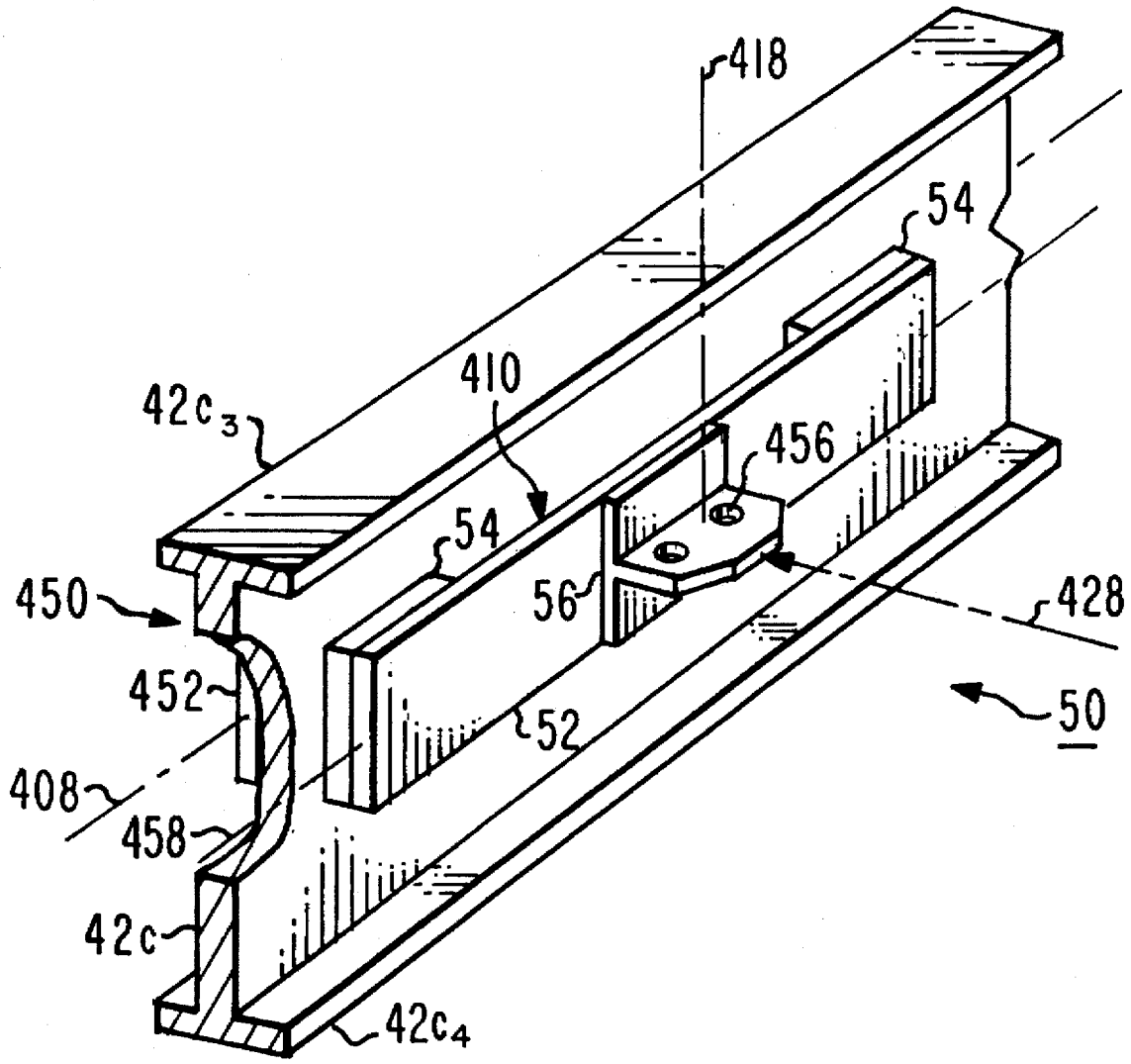
FIG. 4 is a simplified perspective or isometric view of one of the flex mountings of FIG. 3.

As illustrated in FIG. 3, each tile mounting arrangement 50 includes an elongated flex beam 52, a pair of mounting spacers 54, and a tile mounting bracket 56 with an aperture for a screw 323 for fastening tile 22 by way of a screw aperture 322. FIG. 4 is a more detailed view, in perspective or isometric view, of a representative flex mounting arrangement 50 mounted on support beam 42*c*. In FIG. 4, flex beam 50 is elongated parallel to an axis 458, and its web defines width and thickness dimensions. It should be noted that the web is not exploded in FIG. 4 as it is in FIG. 3, so separate designators $42c_1$ and $42c_2$ are not needed. The axis of elongation 458 of elongated flex beam 50 lies parallel to the axis of elongation 408 of support beam 42*c*. The larger flat side of flex beam 52 is parallel to the larger flat side of the web of support beam 42*c*. Flex beam 52 is held in place, spaced away from the surface of the web of support beam 42*c*, by a pair of standoffs or mounts 54, one of which is located at each end of flex beam 52. Standoffs or mounts 54 are located near the ends of the flex beam 52 in such a manner as to leave a gap 410 between the center of the flex beam 52 and the associated web of support beam 42*c*. Thus, flex beam 52 can flex toward or away from the surface of the web of support beam 42*c*, which has the effect of narrowing or widening gap 410. A tile mount 56, illustrated as a section of a tee-shaped extrusion, is mounted at a location half-way between the standoffs or mounts 54, where it can move as the flex beam 52 flexes. Tile mount 56 defines an aperture 456, which allows passage of a mounting screw or bolt to fasten the edge of a tile to the flex beam, as mentioned in conjunction with FIG. 3. A preferred embodiment of the invention provides more than a single aperture 456, so that moments applied about the flex beam longitudinal axis are transferred to bracket 56 and to flex beam 52.

In FIG. 4, a portion of the web of support beam 42*c* is cut away to illustrate a second flex mounting arrangement designated 450, of which only a portion of flex beam 452 is visible. Flex mount 450 is mounted on the other side of the web from flex mount 50, and provides a portion of the support for another tile lying adjacent to the one supported by flex mount 50. This illustration shows why such a mounting scheme allows the two mutually adjacent sides of two adjacent radiating tiles to be sufficiently close to avoid grating lobes and gain loss.

Figure 5:
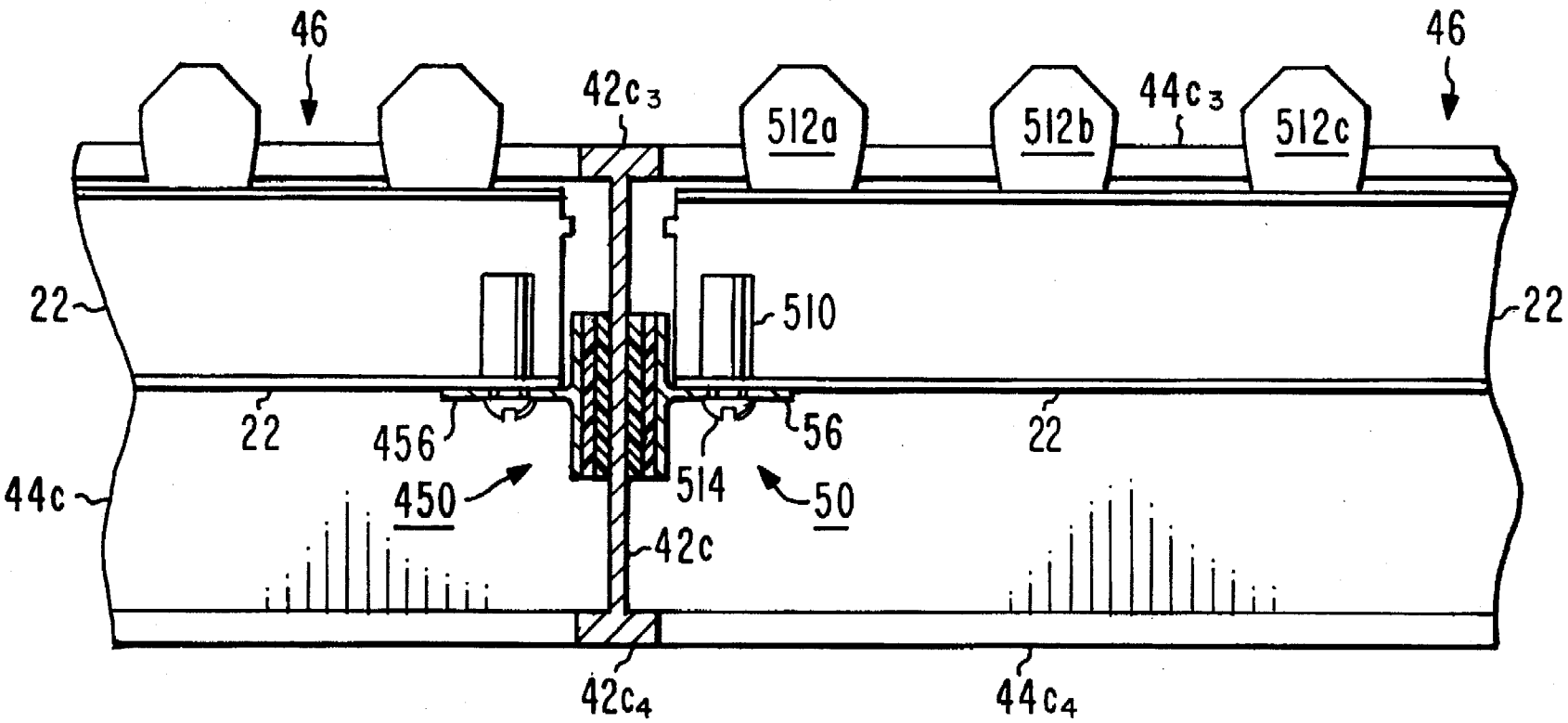
FIG. 5 is a cross-section of the flex mounting of FIG. 4.

FIG. 5 is a cross-section of a portion of the structure of FIG. 3, illustrating the exemplary support beam 42*c*, two flex mounting arrangements 50, 450 in mutually adjacent apertures 46, and associated portions of two radiating tiles 22 and their antennas. In FIG. 5, each radiating tile 22 has a plurality of antennas, some of which are illustrated as 512*a*, 512*b*, 512*c*, . . . which are part of a subarray mounted on each of the tiles. Each tile 22 is mounted along its edge to a tile mounting bracket such as 56 or 456, with a screw such as 514 extending through the aperture (aperture 323 described above) for fastening tile 22 to the flex mount. The arrangement of FIG. 5 is repeated at four locations about each tile, for fastening each tile to the support structure at four places.

As mentioned above, the support structure is strengthened by the presence of the radiating tiles 22 fastened in the apertures 46. It may be desirable to provide lightweight "dummy" support tiles to fill in any apertures which are not fitted with functional radiating tiles, to triangulate the structure to prevent "weak spots".

Flex beam 52 is preferably made from graphite-reinforced polymer, and mounting pads 54 are similarly made from graphite-reinforced polymer, bonded to the underlying support beam 42*c* and to the ends of flex beam 52. Mounting bracket 56 is preferably a titanium extrusion, bonded to the center of flex beam 52. Flex beam 52 of FIG. 4 resists forces acting parallel to axis 458, at least because a part of the beam goes into tension and transfers the load through one of the mounting pads 54 to the support beam 52. Flex beam 52 also resists forces applied to mounting bracket 56 in the direction of arrow 418, because the flex beam is relatively rigid in this direction, and tends to transfer such forces to beam 42*c*. However, forces acting on mounting bracket 56 in the direction illustrated by arrow 428, orthogonal to both axes 418 and 458, tend to flex the flex beam 52. When a tile made from aluminum or other material having a significant coefficient of thermal expansion (CTE) is mounted in an aperture 46 of FIGS. 1, 2, or 3, and fastened to the four flex beams surrounding the aperture, the thermal expansion and contraction are accommodated by flexure of the flex beams of the flex mounting arrangements.

Figure 6A:
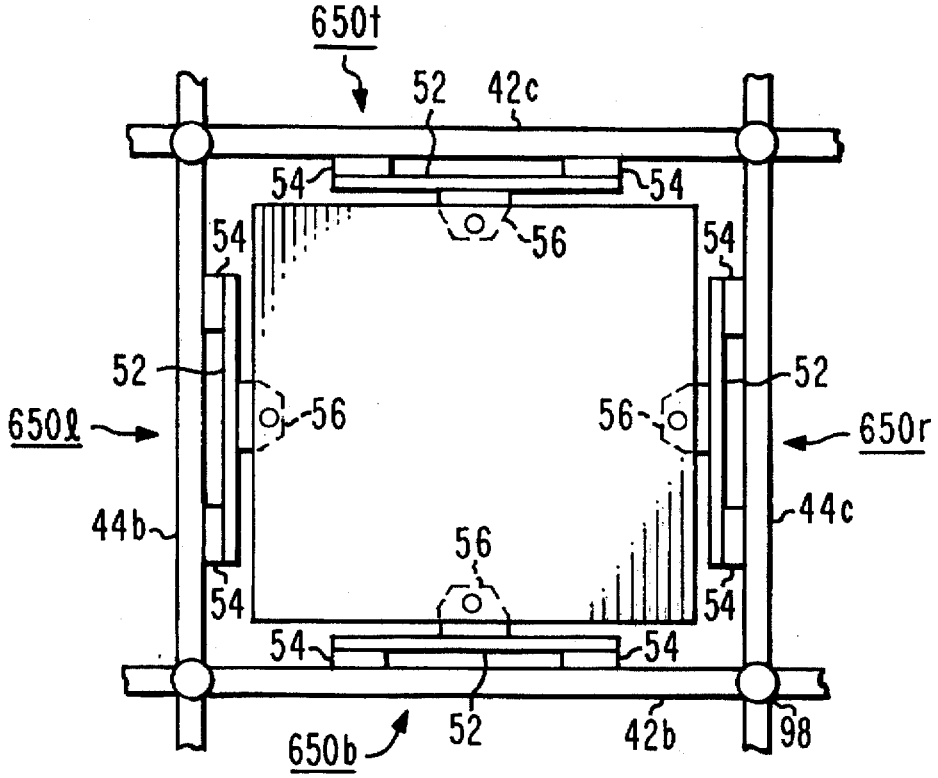
FIG. 6*a* is a simplified illustration of the nominal or room-temperature state of a radiating tile mounted in a frame by flex mounting arrangements, with dimensions exaggerated for clarity.
Figure 6B:
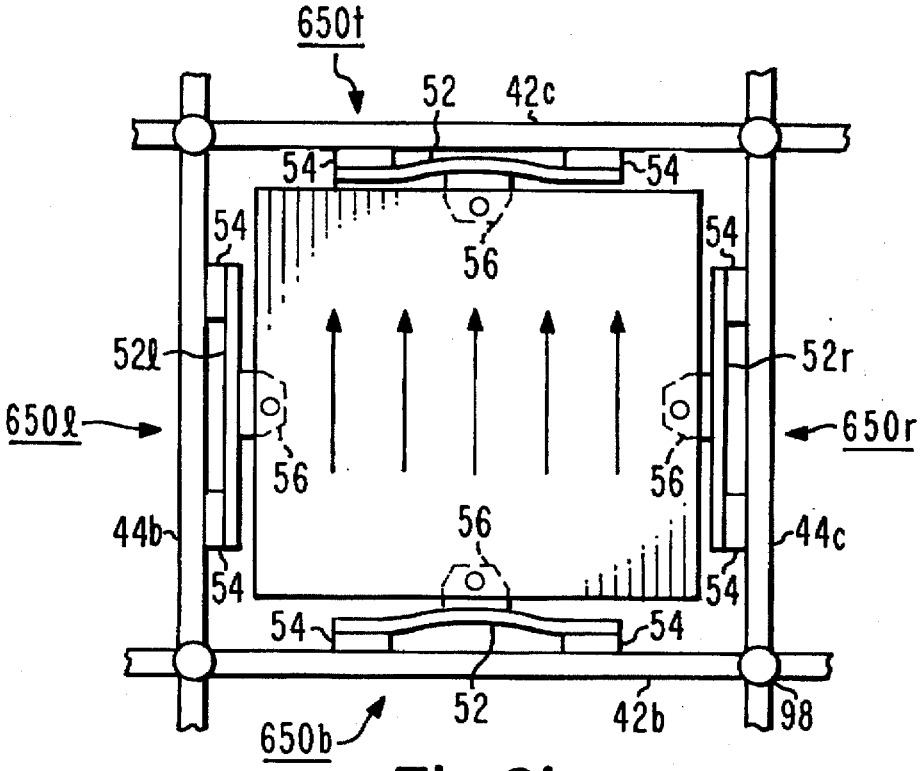
FIG. 6*b* is similar, but shows the effect of application of translational forces to the tile, and illustrating how forces acting parallel to the flex beams are transferred to the eggcrate structure.

FIG. 6*a* is a simplified plan view of one aperture 46 defined by a portion of a support structure, and a radiating tile 22 (or a dummy tile, for that matter) mounted by four flex mounts. The flex mounts of FIG. 6*a* are designated 650*l*, 650*r*, 650*t*, and 650*b* instead of 50, to indicate their right, left, top and bottom positions in the drawing. As illustrated in FIG. 6*a*, no forces act on the radiating tile 22, and the four flex mounts have their flex beams 52 in a normal or unflexed condition. FIG. 6*b* illustrates the same aperture and tile, with translational forces acting in the direction of the arrows 610, which is upward in the drawing, and with the support frame constrained at the spider locations 98. Forces acting parallel to flex beams 52L and 52R cause the top portions of both the flex beams 52L and 52R and the left and right structural members to react to the force in compression. Similarly, the lower portions of flex beams 52L, 52R and the structural elements react in tension. The translations due to these tensile and compressive forces are small, and only slightly flex the flex beams 52T and 52B. Due to the compliance of flex beams 52T and 52B, no forces are imparted to structural members 42*b* and 42*c*. The left and right flex mounts 52L and 52R carry the translational forces to their associated frame members by a combination of tensile forces in half the flex beam and compressive forces in the other half of the flex beam. While the left and right flex mounts 52L and 52R tend to maintain the tile 22 within the aperture 46, there may be some slight relative motion of the tile relative to the frame.

Figure 6C:
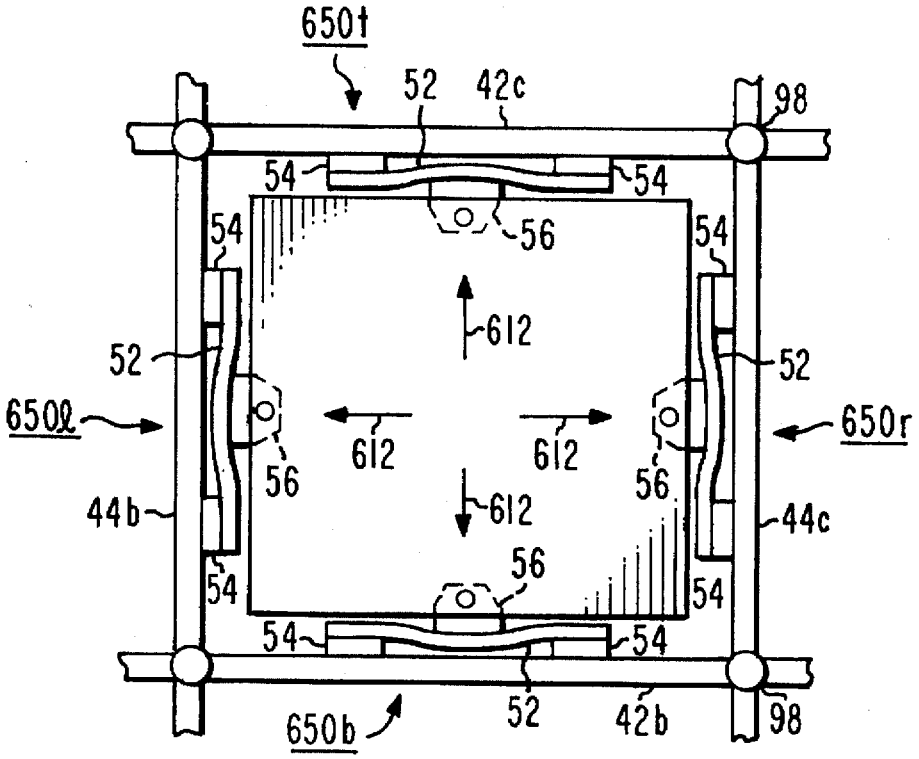
FIG. 6*c* is similar to FIG. 6*a*, but shows the effect of expansion of the tile at elevated temperatures.
Figure 6D:
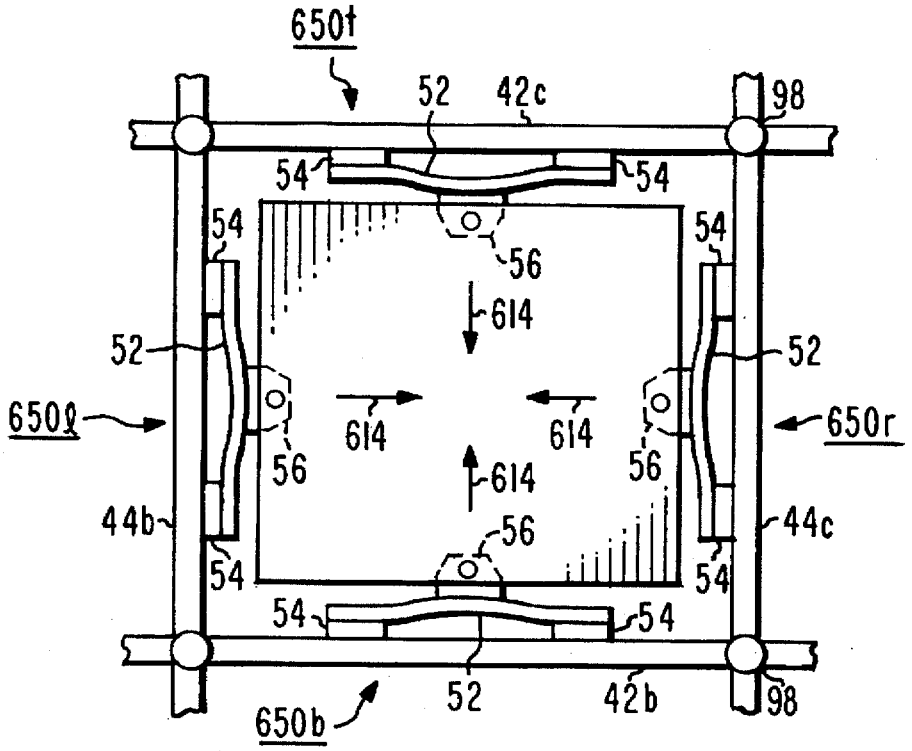
FIG. 6*d* is similar to FIG. 6*c*, but for low temperatures at which the tile contracts.

FIG. 6*c* illustrates the same aperture and tile as FIG. 6*a*, with forces attributable to thermal expansion of the tile suggested by arrows 612. As a result of the expansion forces, the flex beams 52 of all the flex mounts 650*l*, 650*r*, 650*t*, and 650*b* tend to be or are flexed toward their respective beams 44*b*, 44*c*, 42*c*, and 42*b*. Similarly, FIG. 6*d* illustrates the same aperture and tile as FIG. 6*a*, with forces attributable to contraction of the tile suggested by arrows 614. As a result of the contraction forces, the flex beams 52 of all the flex mounts 650*l*, 650*r*, 650*t*, and 650*b* are flexed away from their respective beams 44*b*, 44*c*, 42*c*, and 42*b*.

Figure 7A:
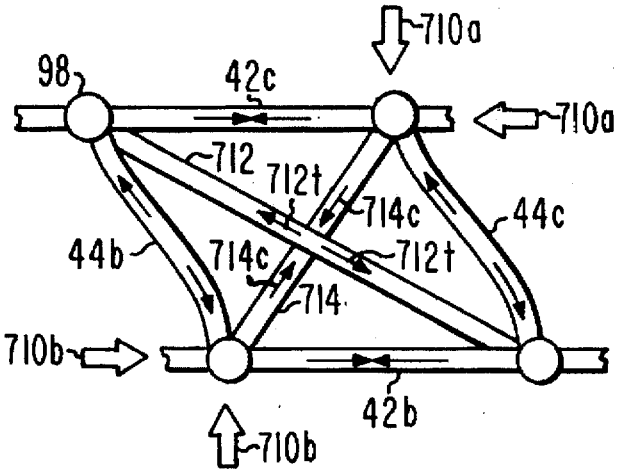
FIG. 7*a* is a skeletonized structure illustrating deformation in the presence of forces applied parallel to the structural elements.

In FIG. 7*a*, a frame is subjected to forces illustrated by arrows 710*a* and 710*b*. In response to the forces, the frame tends to distort in the manner shown. The two diagonal reinforcing members 712 and 714 represent the desired effect of the presence of the rigid tile in the frame. As illustrated by arrows 712*t*, reinforcing member 712 is in tension, while arrows 714*c* indicate that member 714 is in compression. Similarly, frame members 42*b* and 42*c* are in compression, while frame members 44*b* and 44*c* are in tension.

Figure 7B:
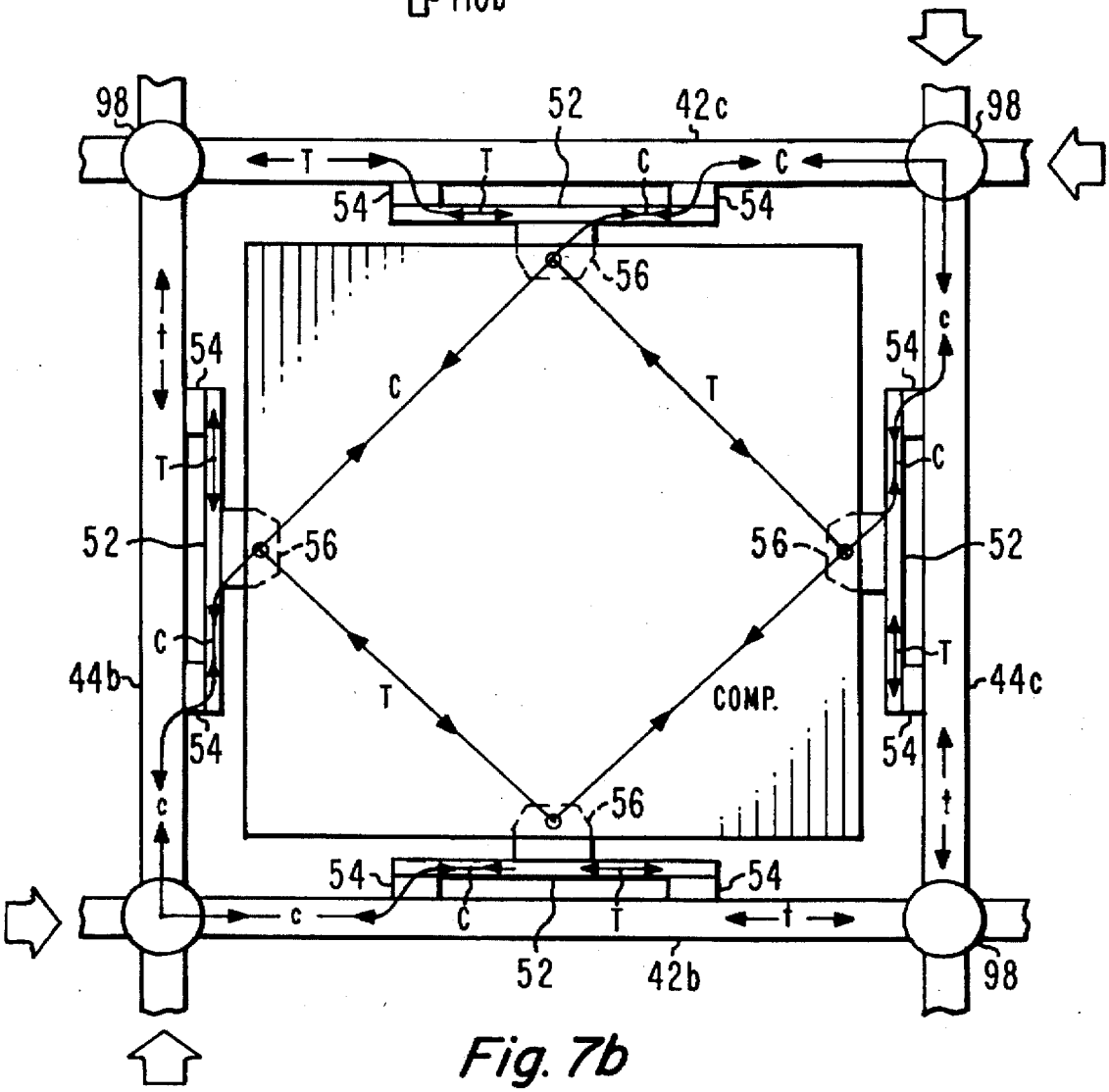
FIG. 7*b* illustrates the transfer of compressive and tensile forces in a frame subject to the same forces.

FIG. 7*b* illustrates in more detail how the forces are distributed through the frame and tile combination. Elements of FIG. 7*b* corresponding to those of the other FIGURES are designated by like reference numerals. In FIG. 7*b*, forces are indicated by arrows, and tensile forces are marked with the letter t, while compressive forces are marked with the letter c.

Figure 8A:
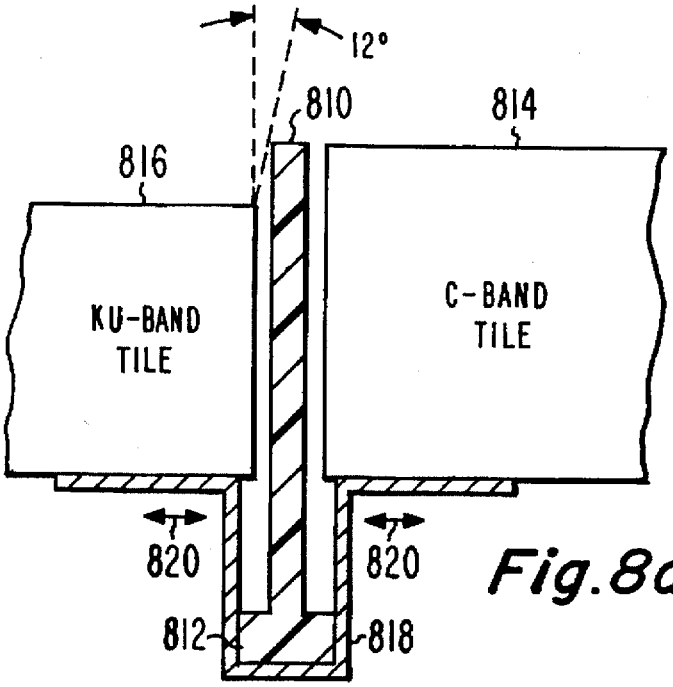
FIG. 8*a* illustrates an alternative method for suspending the tiles within a frame.
Figure 8B:
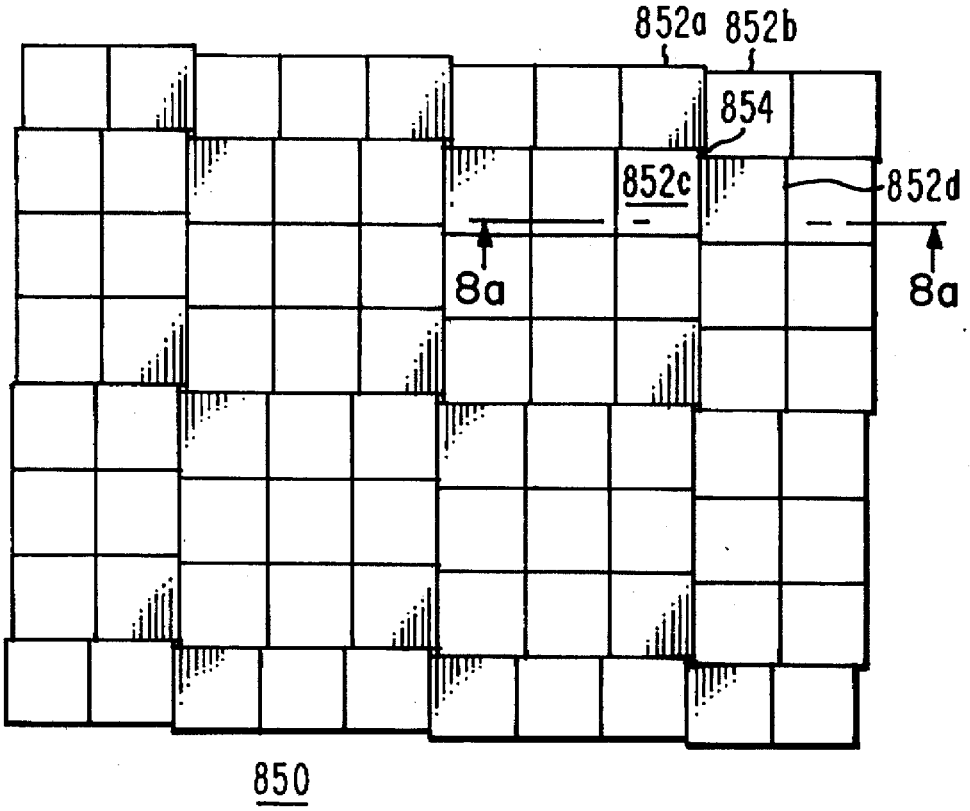
FIG. 8*b* is a simplified diagram of an offset tile array which provides apertures for cable ties.

FIG. 8*b* illustrates an array 850 of radiating tiles set in a frame, with the tiles arranged in sets of nine, with each set of nine tiles offset from the adjacent sets, so that an aperture is left at corners of the sets. Thus, tiles 852*a*, 852*b*, 852*c*, and 852*d* are corner tiles of four different sets of nine, and leave a square aperture 854 through which tie cables can be run.

FIG. 8*a* is a cross-section of the arrangement of FIG. 8*b*, illustrating a tee-shaped structural member 810 with a web 810*w* and a flange 812. A tile 814 lies near the web 810*w* and is selected for radiating electromagnetic energy in C-band, while another tile 816 is arranged in the adjacent aperture for radiation at $K_u$ band. Tile 816 is not as thick as tile 814, and consequently, it is recessed below the frame lip level. The recessing is selected so that the lip of the frame member 810 does not shadow the edge of radiating tile 816 at angles less than 12°, although, of course, other angles might be selected. Tiles 814 and 816 are mounted in place by a flexible beryllium-copper spring bracket 818, which is bonded to flange 812 and to the bottoms of the radiating tiles 814 and 816, allowing motion of the tile edges in the directions indicated by arrows 820, to thereby allow for expansion and contraction. In one embodiment, the spring bracket has a thickness of 0.005 inch, and a length (in a direction normal to the plane of FIG. 8*a*) of 1.0 inch. The arrangement described in conjunction with FIGS. 8*a* and 8*b* has the advantages of very close spacing of the edge of the tile to the frame members, and the a periodic nature of the array of tiles tends to have lower grating lobes, and hence higher aperture efficiency.

The combination of the four flex mounts according to the invention in the described frame, and the longitudinal stiffness provided by each flex beam, together with the stiffness or rigidity of the radiating tile along its diagonals, provides triangle-like support of the rectangular opening, to enhance the structural strength of the frame against mutually opposing forces directed parallel with the support beams or diagonally applied forces. Further, the flex support positions the radiating tiles within the aperture in the frame in a manner which provides stiffness in six degrees of freedom of motion of the tile, namely three translations (x, y, and z), and three rotations, about x, y, and z axes. A salient advantage of the arrangement according to the invention is that the dimensions of an array antenna (measured in tiles), or its operating frequency, may be readily changed, by simply removing tiles from the frame, and installing other tiles having the desired characteristics. Thus, if the current design of a spacecraft includes four tiles in a particular frequency band, and the customer requirement for directive gain increases, dummy tiles can be removed, and additional tiles which radiate in that frequency band can be added to the frame. Similarly, the configuration, morphology or shape of the radiating tile array can be symmetrical or asymmetrical, to aid in meeting footprint goals.

Other embodiments of the invention will be apparent to those skilled in the art. For example, while structures 18*a* and 18*b* have been described as antennas, each such structure may include a plurality of separate radiators which operate at different frequencies or polarizations to transduce different information, and may include facilities for simultaneous transmission and reception. While an 8×10 array of tiles has been illustrated and described, the arrays may be of any desired dimension, and may be square, rectangular, or of some other shape. An antenna array tile 22 of one panel 20 may coact electromagnetically with another array tile of the same panel 20, or of another panel 20, to provide greater directivity than one tile or panel alone. While the upper and lower flanges of the support I-beam have been illustrated as being of the same size, they may have different dimensions. While two spacers have been described for supporting the flex beam on the support beam, more or fewer spacers may be used. While the tile mounting bracket 56 has been illustrated as lying about half-way between the upper and lower flanges of the support I-beam, the position in the aperture at which the radiating tile is supported may be selected in accordance with its thickness and the details of the mounting flange and its tile interface. The beam webs may be perforated for weight reduction, if desired. While conventional antenna arrays have been described, in which the antenna elements are fed by beamformers, the mounting principles of the invention are applicable to reflect arrays, such as that described in U.S. Pat. No. 5,280,297, issued Jan. 18, 1994 in the name of Profera, where the element spacing of the array antennas is to be maintained over the array. While the I-beams have been described as monolithic, they may be made by interlocking one or two flanges with each web, and gluing the resulting flange-web joint, or by any other fabrication technique.

What is claimed is:

1. An array antenna, comprising:

a frame including a plurality of straight, elongated support beams, interconnected in two mutually orthogonal sets so as to, together, define a rectangular two-dimensional array of a first plurality of mutually identical rectangular openings, said frame being subject to distortion in response to forces acting on said frame parallel to said support beams;

a second plurality, which is no greater than said first plurality, of rectangular, electromagnetically radiating tiles, each of said radiating tiles having length and width dimensions selected to fit within said openings, and having a thickness dimension much less than either of said length and width dimensions;

mounting means affixed to each of said tiles and to the associated ones of said openings in said frame, for holding each tile in an associated opening of said frame, each of said mounting means including four mounts, each of said mounts being affixed to the center of one of the sides of the associated one of said radiating tiles and to the center of one of said support beams defining an edge of said associated one of said openings, each of said mounts including (a) an elongated flex beam defining a thickness dimension, a width dimension greater than said thickness dimension, and a length dimension greater than said width dimension, (b) spacing means coupled to said flex beam and to said associated one of said support beams, whereby the center of said flex beam may deflect toward and away from the center of said associated one of said support beams, and (c) further connection means connecting the associated side of said radiating tile to said flex beam, whereby expansion and contraction of said radiating tile cause said center of said flex beams to deflect toward and away from, respectively, their associated support beams, whereby each of said radiating tiles remains centered in its associated opening, and whereby the combination of said four mounts, and the longitudinal stiffness provided by said flex beam, together with the stiffness of said radiating tile along its diagonals, provides triangle-like support of said rectangular opening, to enhance the structural strength of said frame against forces directed parallel with said support beams.

2. An antenna according to claim 1, wherein said spacing means coupled to said flex beam and to said associated one of said support beams comprises a pair of spacers, each of which is affixed to an end of its associated flex beam and to the side of said associated one of said support beams.

3. An antenna according to claim 2, wherein said support beam includes a web and a flange, and said pair of spacers is affixed to said web.

4. An antenna according to claim 1, wherein each of said radiating tiles includes an array of radiating elements.

5. An antenna according to claim 1, wherein said rectangular openings are square, and said radiating tiles are square.

6. An antenna according to claim 1, wherein at least one of said radiating tiles of said array operates in a first frequency range, and another of said radiating tiles operates in a second frequency range, different from said first frequency range.

7. An antenna according to claim 6, wherein a plurality of said radiating tiles of said array radiate in said first frequency range, and a plurality of said radiating tiles of said array radiate in said second frequency range.

8. An antenna according to claim 1, wherein said frame lies essentially in a plane, and the plane of said tile is parallel to said plane of said frame.

9. An array antenna according to claim 1, wherein said spacing means comprises first and second spacers coupled to the ends of said flex beam and to said associated one of said support beams, whereby a center portion of said flex beam is not supported by a spacer, and may deflect toward and away from the associated one of said support beams; and said further connection means connecting the associated side of said radiating tile to said flex beam comprises means for connecting the center portion of said associated side of said radiating tile to said center portion of said flex beam.

10. A spacecraft, comprising:

a plurality of array antennas, each of said array antennas comprising:

a frame including a plurality of straight, elongated support beams, interconnected in two mutually orthogonal sets so as to, together, define a rectangular two-dimensional array of a first plurality of mutually identical rectangular openings, said frame being subject to distortion in response to forces acting on said frame;

a second plurality, which is no greater than said first plurality, of rectangular, electromagnetically radiating tiles, each of said radiating tiles having length and width dimensions selected to fit within said openings, and having a thickness dimension much less than either of said length and width dimensions;

mounting means affixed to each of said tiles and to the associated ones of said openings in said frame, for holding each tile in an associated opening of said frame, each of said mounting means including four mounts, each of said mounts being affixed to the center of one of the sides of the associated one of said radiating tiles and to the center of one of said support beams defining an edge of said associated one of said openings, each of said mounts including (a) an elongated flex beam defining a thickness dimension, a width dimension greater than said thickness dimension, and a length dimension greater than said width dimension, (b) a pair of spacers, each of which is affixed to an end of its associated flex beam and to the side of said associated one of said support beams, whereby the center of said flex beam may deflect toward and away from the center of said associated one of said support beams, and (c) further connection means connecting the center of the associated side of said radiating tile to the center of said flex beam, whereby expansion and contraction of said radiating tile cause said center of said flex beams to deflect toward and away from, respectively, their associated support beams, whereby each of said radiating tiles remains centered in its associated opening, and whereby the combination of said four mounts, and the longitudinal stiffness provided by said flex beam, together with the stiffness of said radiating tile along its diagonals, provides triangle-like support of said rectangular opening, to enhance the structural strength of said frame.

* * * * *